US005669372A

United States Patent [19]

Humphrey

[11] Patent Number: 5,669,372

[45] **Date of Patent: *Sep. 23, 1997**

[54] SAFETY DEVICE FOR A COOKING RANGE

[76] Inventor: Doyce Humphrey, P.O. Box 405, Westport, Conn. 06881

[ * ] Notice: The term of this patent shall not extend beyond the expiration date of Pat. No. 5,431,146.

[21] Appl. No.: 499,166

[22] Filed: Jul. 7, 1995

Related U.S. Application Data

[63] Continuation of Ser. No. 243,227, May 13, 1994, which is a continuation-in-part of Ser. No. 50,891, Apr. 21, 1993, Pat. No. 5,323,757.

[51] Int. Cl.[6] ..... F24C 15/30

[52] U.S. Cl. ..... 126/24; 126/212; 126/214 D

[58] Field of Search ..... 126/24, 212, 214 D, 126/214 C, 215

[56] References Cited

U.S. PATENT DOCUMENTS

| | | | |
|---|---|---|---|
| 702,489 | 6/1902 | Scherer | 126/215 |
| 1,905,069 | 4/1933 | Stair | 248/206.3 |
| 3,960,134 | 6/1976 | Scott | 126/24 |
| 4,108,140 | 8/1978 | Wolze | 126/24 |
| 4,448,186 | 5/1984 | Smith | 126/24 |
| 4,620,526 | 11/1986 | Tetschner | 126/24 |
| 4,638,786 | 1/1987 | Lucky | 126/24 |
| 4,934,333 | 6/1990 | Ducate et al. | 126/24 |
| 5,323,757 | 6/1994 | Humphrey | 126/24 |
| 5,431,146 | 7/1995 | Humphrey | 126/24 |

*Primary Examiner*—Carroll B. Dority

*Attorney, Agent, or Firm*—Lackenbach Siegel Marzullo Aronson & Greenspan, P.C.

[57] ABSTRACT

A safety device for a cooking range having at least one burner grid with supporting radial bars include an open-top receiving member and a plurality of circumferentially spaced anchoring members extending outwardly from the receiving member. Each anchoring member has a pair of spaced legs adapted to straddle one of the radial bars, so that the receiving member is prevented from a lateral and rotational displacement.

14 Claims, 6 Drawing Sheets

SAFETY DEVICE FOR A COOKING RANGE

This is a continuation of application Ser. No. 08/243,227, filed May 13, 1994, which is a continuation-in-part application of U.S. patent application Ser. No. 050,891, filed Apr. 21, 1993, now U.S. Pat. No. 5,323,757, granted Jun. 28, 1994.

FIELD OF THE INVENTION

This invention relates generally to safety devices and more particularly to a safety device which prevents lateral displacement and over turning cooking stoves and/or vessels positioned on cooking ranges or stoves.

BACKGROUND OF THE INVENTION

Portable stoves for camping and boating use are generally carried or stored between uses, and therefore must be relatively small and light. Typically, these stoves utilize butane or propane from tanks or bottles carried inside the stove itself. The stove is usually placed on the ground or on a table, lighted and used.

Stoves that are used aboard a boat or in a motor home may present a severe hazard if they are not secured in the position of use. Marine stoves are often attached to a table or other support structure. Stoves in motor homes or campers are merely set in place as they are not normally used while the vehicle is in motion.

The cooking ranges and stoves have typically used supporting girds provided with a plurality of circumferentially spaced fingers or bars on which the cooking vessels or utensils, such as pots, pans, etc. are placed. Such utensils are often free to slide laterally on the girds and are easily displaced by accidents. These dangerous situations are particularly common when the stove is installed on a boat, mobile home, travel trailer or the like, where lateral movement of a vehicle often occurs, causing the stove and/or cooking utensil to slide off a supporting structure.

According to the present invention there is provided a safety device preventing lateral movement or sliding of kitchen utensils comprising a receiving member adapted to closely encircle the utensil and removably mounted on the cooking range or stove so that the receiving member is prevented from lateral displacement but movable in a vertical direction and replaceable when necessary. The receiving member restrains the cooking vessel or kitchen utensil against lateral movements which are likely to lead to its overturning. On the other hand, the receiving member sits freely around the kitchen utensil, so that it can be easily put on or taken off a heating position without disturbing the content of the utensil.

In the past, attempts have been made to securely and removably fit the rings of the supporting girds within the cooking range. For example, U.S. Pat. No. 3,198,189 to A. F. Oatley suggests that the ring should be hinged to a support about a horizontal axis enabling it to be swung up out of the way. Furthermore, certain fairly complicated arrangements are disclosed by the prior art for locating a ring at each of the heating positions, as well as a set of different diameter rings to suit a range of kitchen utensil sizes.

The present invention provides a simple and inexpensive safety device for a cooking range which effectively prevents lateral movement of the cooking stove and/or vessel or kitchen utensils, and the receiving member when the base on which the cooking range is installed is moved or displaced by accident. One of the most typical applications of the present application is when the cooking range or stove is positioned on a boat, mobile home, travel trailer, where the lateral movement of the vehicle causes the stove to move off a table or for the kitchen utensil to slide off the grids.

BRIEF DESCRIPTION OF THE DRAWINGS

Other advantages and features of the invention are described with reference to exemplary embodiments, which are intended to explain and not to limit the invention, and are illustrated in the drawings in which.

DETAILED DESCRIPTION OF THE INVENTION

Although specific embodiments of the invention will now be described with reference to the drawings, it should be understood that the embodiments shown are by way of example only and merely illustrative of but one of the many possible specific embodiments which can represent application of the principles of the invention. Changes and modifications, obvious to one skilled in the art to which the invention pertains, are deemed to be within the spirit, scope, and contemplation of the invention as further defined in the appended claims.

Figure 1:
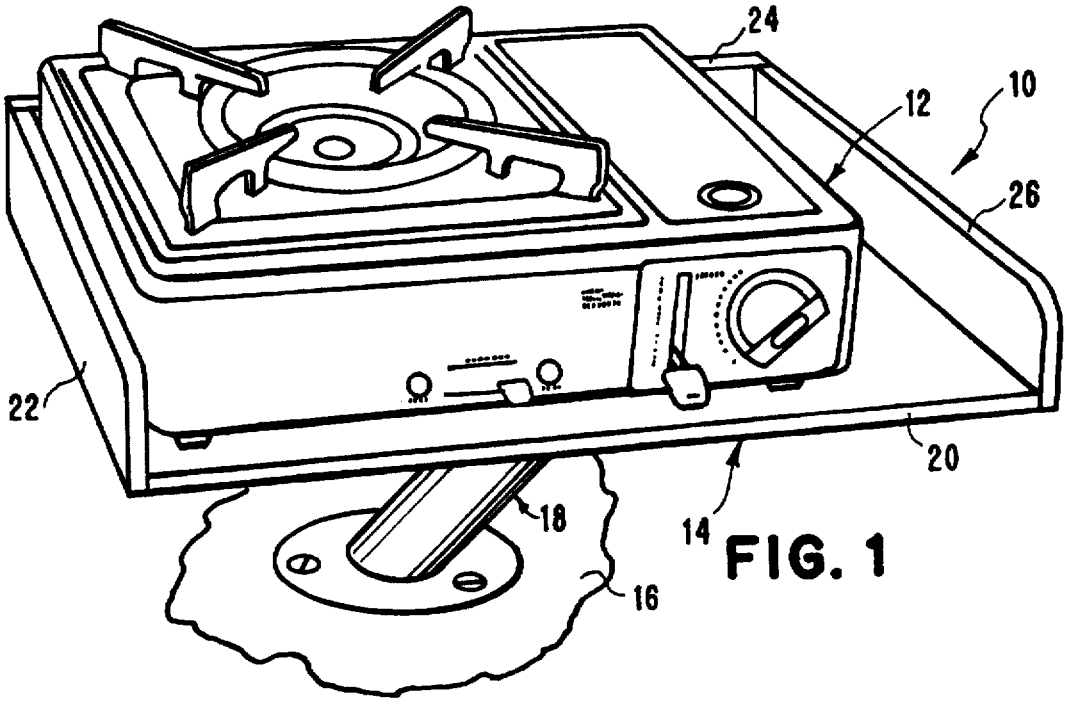
FIG. 1 is a perspective view of a first embodiment of the portable stove mounting apparatus in accordance with the invention.

A perspective view of a stove mounting apparatus 10 in accordance with the invention is shown in FIG. 1. A portable stove 12 used with a vehicle, such as a boat, is fastened to a suitable table or substrate, such as the illustrated fileting board 14. The board 14 is in turn removably mounted to a portion of a boat deck 16 in accordance with the invention via a ranged stanchion 18.

Figure 2:
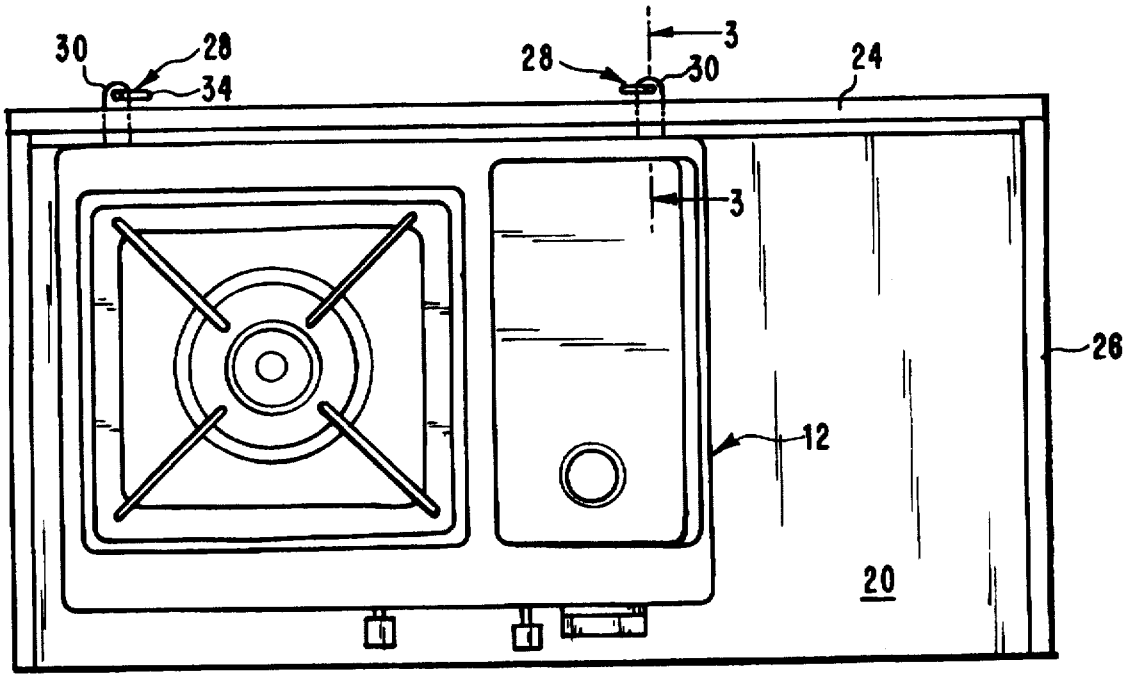
FIG. 2 is a top view of the first embodiment of the invention shown in FIG. 1.

The fileting board 14 has a flat rectangular table portion 20 and three side wall portions 22, 24, and 26 which extend upward orthogonally from the edges of the table portion 20. As is shown in FIG. 2, the back side wall portion 24 may be slightly spaced from the table portion 20 and only fixed to the side wall portions 22 and 26. The table portion may also be fixed to the back wall 24 for added rigidity to the fileting board.

Figure 3A:
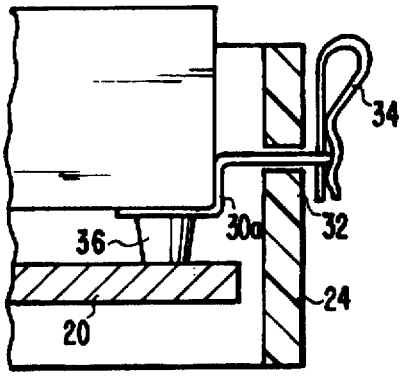
FIG. 3A is a partial vertical sectional view of the first embodiment shown in FIG. 2 taken along the line 3—3.

The stove 12 has a generally rectangular, box shaped frame with four rubber feet positioned at the four corners of the frame. The stove 12 is removably secured to the fileting board 14 by at least one first fastening means 28. In the first embodiment shown in FIGS. 1 and 2, the fastening means 28 includes two offset tangs 30. These tangs 30 extend from the stove 12 up the side of the stove and then outward to protrude through apertures 32 in the back side wall portion 24 of the fileting board 14 as is shown in FIG. 2. Each of the tangs 30 is in turn held in place on the back side of the back wall 24 by a suitable pin, such as a conventional cotter pin 34 as is shown in FIG. 3A. This cotter pin fits through a hole at the end of the tang 30 and with its two legs spread apart prevents withdrawal of the tang until the cotter pin is removed from the hole in the tank.

Figure 3B:
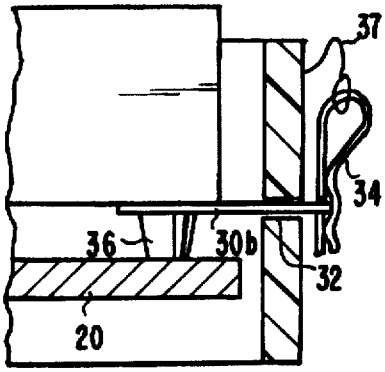
FIG. 3B is a partial vertical sectional view of an alternative first embodiment taken along the line 3—3 in FIG. 2.
Figure 3C:
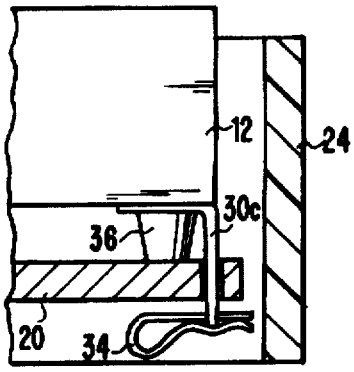
FIG. 3C is a partial vertical sectional view of a second alternative to the first embodiment taken along the line 3—3 in FIG. 2.

Alternative arrangements of the securing means 28 are shown in FIGS. 3A, 3B, and 3C. These embodiments utilize different shapes of tang 30, designated 30*a*, 30*b*, and 30*c*. In 3A, tang 30*a* is offset, that is, it has two horizontal end portions and a vertical mid portion. Each end portion has a hole through it. One end portion is fastened to the stove 12 between the stove foot 36 and the stove with the screw (not shown) that holds the foot 36 to the stove 12. The other end portion of the tang 30*a* extends horizontally through the aperture 32. In FIG. 3B, tang 30*b* is a flat elongated bar which has a hole at each end. One end is fastened between the stove and the stove foot and the other end extends through the aperture 32 in the back side wall. In FIG. 3C, the tang 30*c* is an "L" shaped bar which has its short end attached to the stove 12 at the foot 36. The longer end extends through an aperture 38 in the table portion rather than the back wall 24. This arrangement might be desirable if access to the rear of the back wall 24 is restricted.

The embodiment of the securing means 28 shown in FIG. 3A may be desirable where the stove is to be spaced from the wall portion 24. In this case, end portion fixed to the stove foot would be longer and the vertical mid portion of the tang 30 would thus be spaced from the stove 12 and against the inside surface of the back wall 24. The embodiment shown in FIG. 3C could also be used to achieve the same result. The embodiments shown in FIGS. 3A and 3B may also have longer tangs 30 with a plurality of holes in the tang 30 to adjust the spacing between the stove 12 and the back wall 24. In this case, a second cotter pin (not shown) would be placed through a hole in the tang 30 on the inside of the back wall 24. Another alternative, also not shown, would be for the tangs 30 to extend from the stove feet to the side of the stove 12 and extend through apertures in either of the side walls 22 or 26. These alternatives are not illustrated but are equivalent to the embodiments shown.

Figure 4:
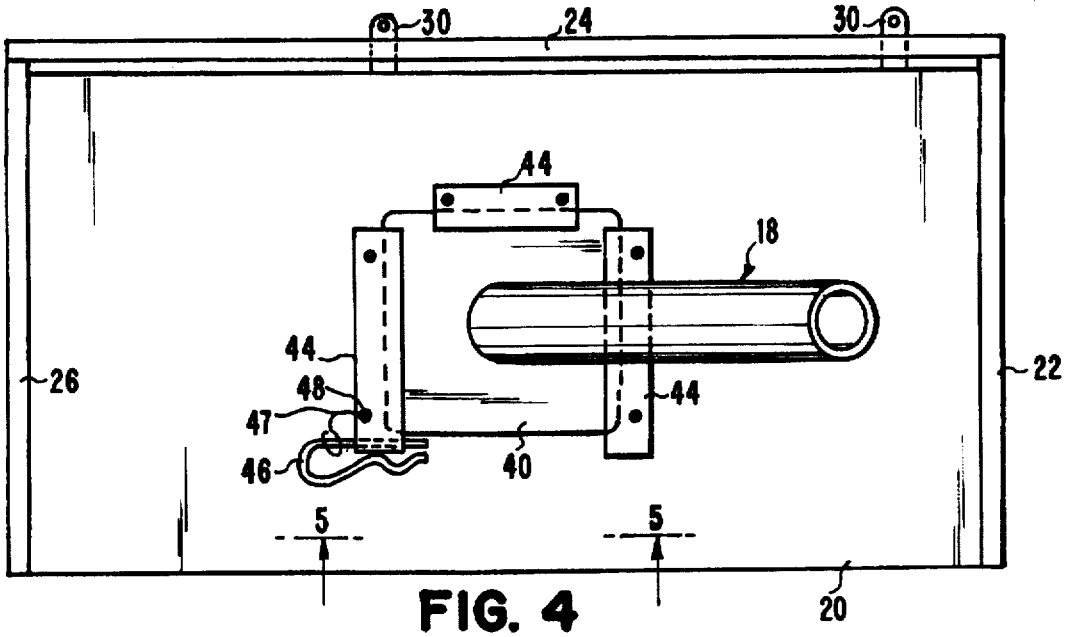
FIG. 4 is a bottom view of the apparatus of the present invention shown in FIG. 1.
Figure 5:
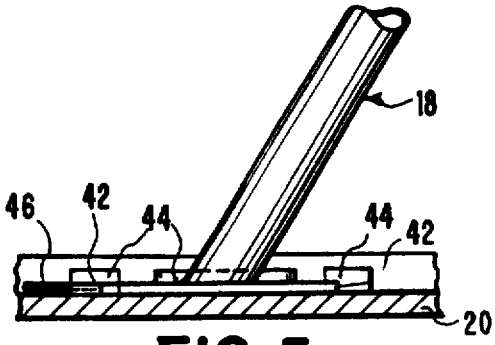
FIG. 5 is a partial sectional view taken along the line 5—5 in FIG. 4.

A second securing means, for removably securing the fileting board to a fixture of the boat or other vehicle is shown in FIG. 4. FIG. 4 is a bottom view of the fileting board 14. A stanchion 18 extending from the deck 16 of a boat has a flat, generally rectangular, horizontally positioned top flange 40. This top flange 40 slides into corresponding spaced grooves 42 in the underside of the fileting board 14. These grooves may be integrally formed in the board 14 or may be formed by rabbeted cleats 44 screwed and glued to the underside of the board 14 as shown in FIGS. 4 and 5. The flange 40 is held in place in the grooves 42 by another cotter pin 46 which fits into a bore through one of the cleats 44 and extends into the groove 42 to prevent movement of the flange 40 as shown in FIG. 5.

Figure 6:
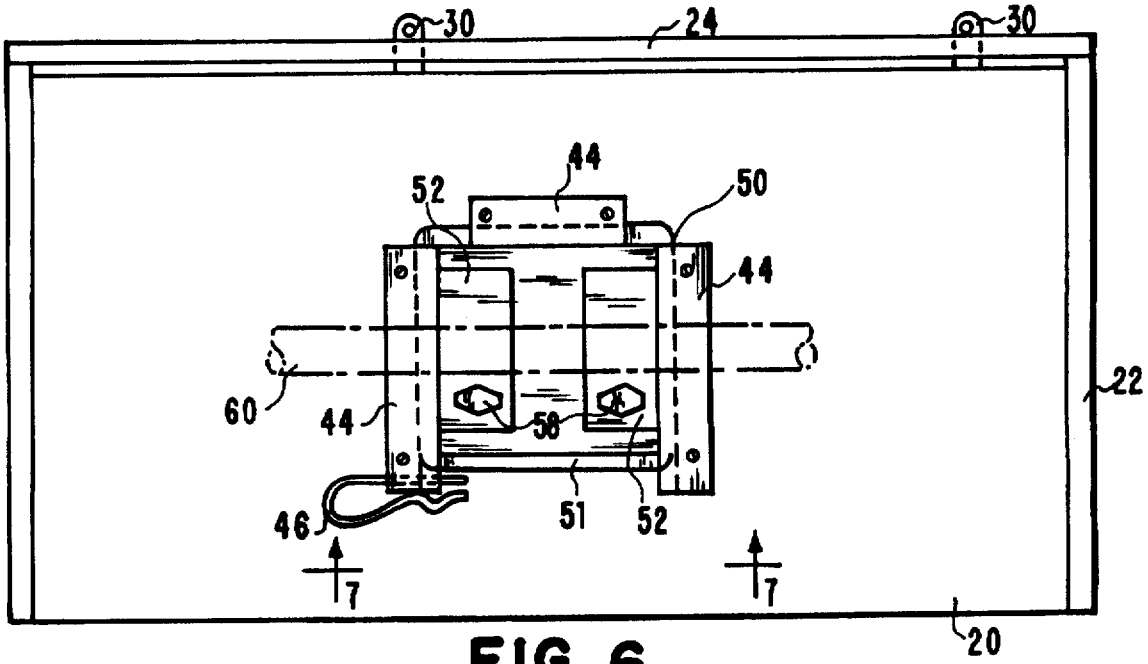
FIG. 6 is a bottom view of a second embodiment of the apparatus in accordance with the present invention.
Figure 7:
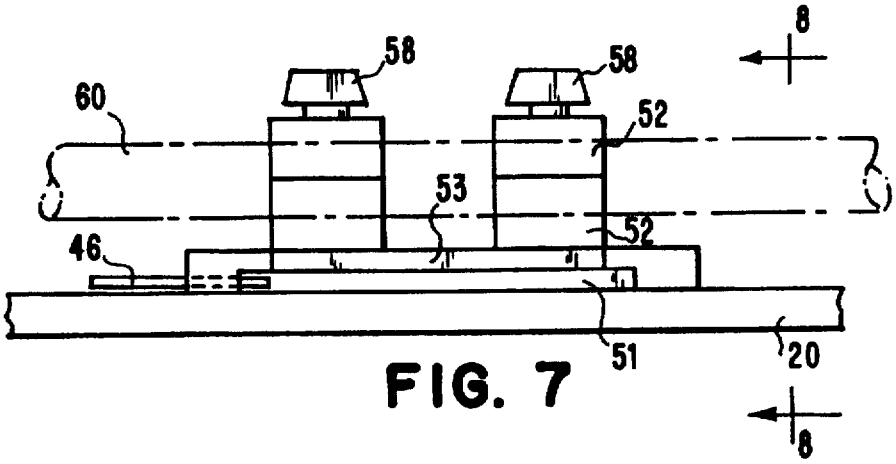
FIG. 7 is a partial side view of the second embodiment shown in FIG. 6 taken along the line 7—7 in FIG. 6.
Figure 8:
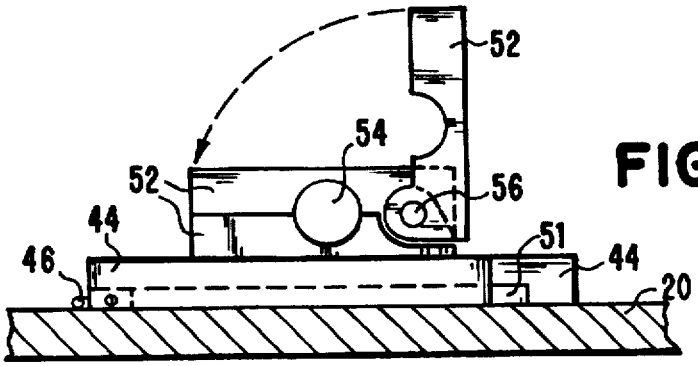
FIG. 8 is a side view of the second embodiment shown in FIG. 6 taken along the line 8—8 in FIG. 7.

If the fileting board 14 and stove 12 are to be secured to a horizontal tubular railing 60, the second securing means is a clamp assembly 50 used in place of the flanged stanchion 18. The clamp assembly 50 is shown in FIGS. 6 through 8. The clamp assembly 50 comprises a flange 51 similar to the flange 40 just described, a clamping plate 53 fixed to the flange 51, and two pairs of spaced jaw members 52 that each have a straight arcuate bottomed groove 54 in one face. One jaw member 52 of each pair is fixed to the clamping plate 53. The other is movable and has one end pivotally connected to the fixed jaw 52 by a pin 56. The opposite ends of the jaws 52 are fastened together by thumb screws 58 as shown in FIG. 7.

The flange 53 slides in grooves 42 as in the embodiment just described and is also held in the grooves 42 by a cotter pin 46. The radius of the groove 54 should be the same as that of the tubular railing 60 upon which the assembly 50 is to be mounted. The depth of the groove 54 should be less than the radius of the railing so that a firm compressive grip may be established between the jaws 52 when the thumb screws 58 are tightened. Once the clamp assembly 50 is installed on the railing 60, the fileting board 14 may be installed and removed simply by sliding the board onto the flange 53 and securing it in place with a cotter pin 46 as previously described.

Figure 9:
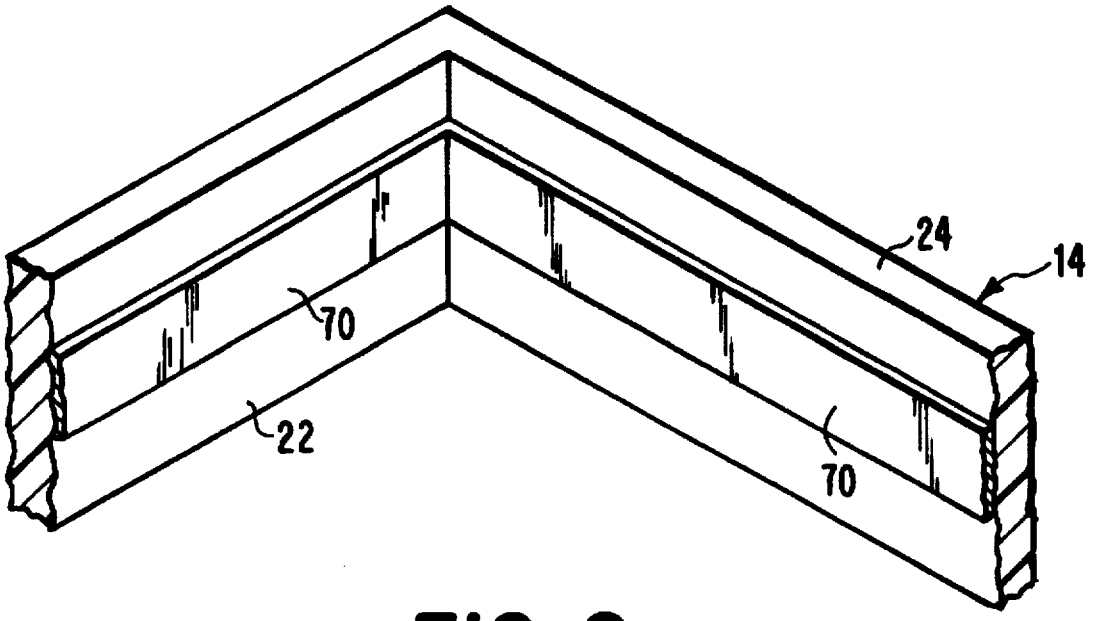
FIG. 9 is a partial perspective sectional view of the vertical side wall portion of the fileting board showing a third embodiment of the fastening apparatus in accordance with the invention.

FIG. 9 shows an alternative first securing means for securing the stove 12 to the fileting board 14. In this alternative, a magnetic strip 70 is adhesively or otherwise fixed to the side and back wall portions 22 and 24. This strip 70 will magnetically hold the stove 12 in the corner between the wall portions 22 and 24 provided the body of the stove is made of steel sheet metal material.

Figure 10:
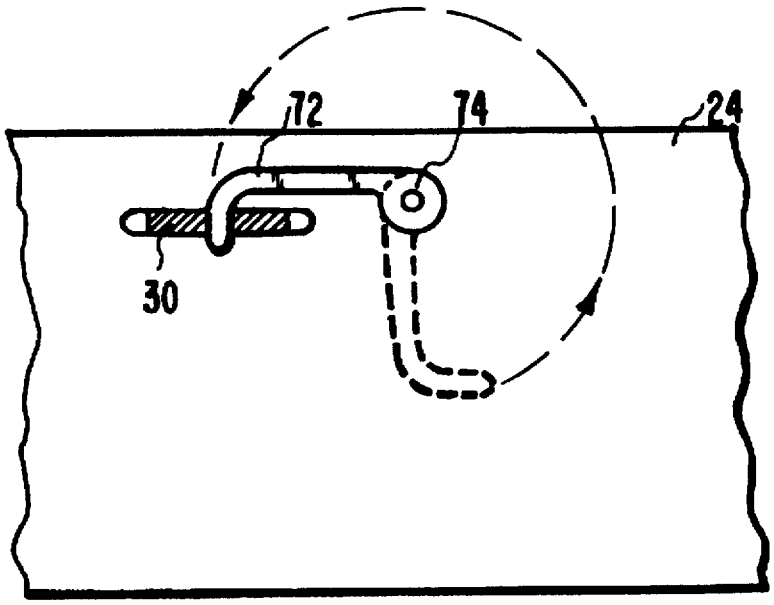
FIG. 10 is a partial rear view of the apparatus shown in FIG. 1 showing an alternative fastening device for the first embodiment.

FIG. 10 shows an alternative to the cotter pin 34 above described in the various embodiments. The tang 30 may be secured to the back wall portion 24 by a hook 72 which is swivelly mounted to the wall 24 by a screw 74. This arrangement would prevent the loss of the cotter pin, although other loss prevention means could be employed such as tethering the cotter pin to the wall portion 24. For example, a tether 37 as shown in FIG. 3B can be used to connect the cotter pin 34 to the back wall portion 24. Similarly a tether 47 as shown in FIG. 4 can be used to connect the cotter pin 46 to one of the screws 48 securing cleat 44 to the underside of the flat rectangular table portion 20.

Figure 11:
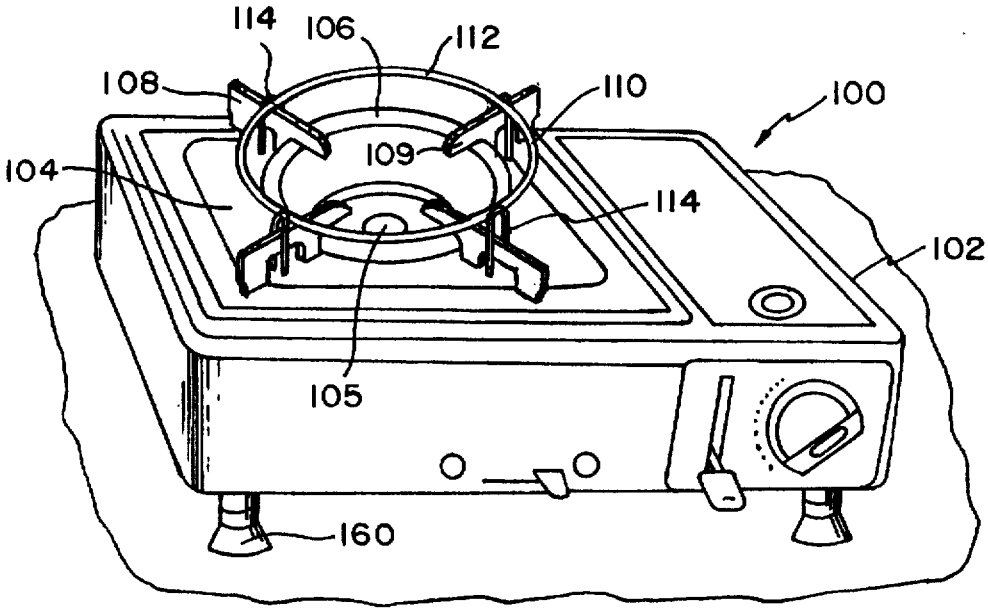
FIG. 11 is a semi-prospective view of the safety device of the present invention positioned within a cooking range.

FIG. 11 depicts a cooking range of a stove including a top portion 102 having at least one recess 104 adapted to receive a burner 105 and an utensil supporting gird 106. The gird is of the conventional design and includes a plurality of supporting radial bars or arms 108. It is common for the radial bars to have a top surface 109 on which a cooking vessel or utensil can rest. Here suction cups 160 attached to the feet of the stove secures same in place to the substrate shown broken away beneath the stove.

The safety device 110 of this invention (see FIGS. 11 and 12) further comprises a receiving member 112 which is disposed substantially horizontally and arranged to be spaced above the top portion 102 of the cooking range and the burner 105. The receiving member 112 is advantageously prevented against lateral displacement while it is position above the burner. However, removal of the receiving member in the upward direction is permitted. The receiving member 112 is typically made from a heat resistance material and has appropriate dimensions to encircle and lightly embrace a conventional kitchen utensil such as a sauce pan, coffee pot, and the like.

Figure 12:
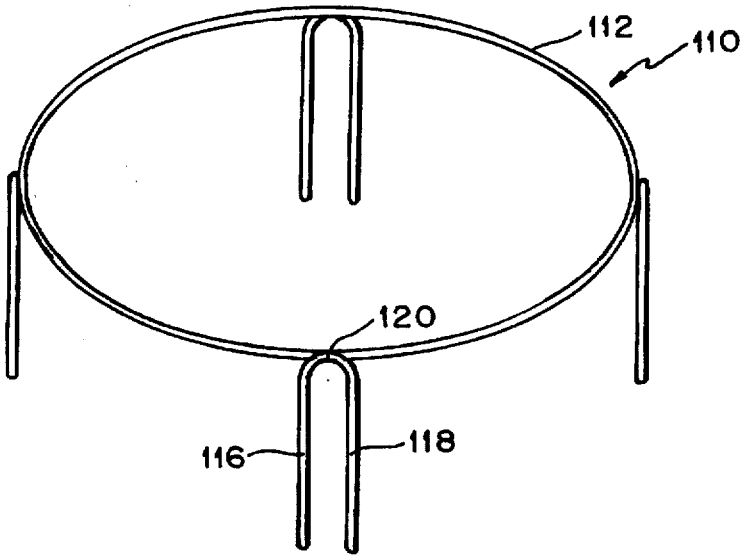
FIG. 12 is a semi-prospective view of a preferred embodiment of the safety device according to the present invention.

In the embodiment of FIGS. 11 and 12 the receiving member 112 is formed as a ring type element. However, any suitable configuration of the receiving member designed to accommodate a conventional cooking vessel or utensil is within the scope of the invention.

Figure 13:
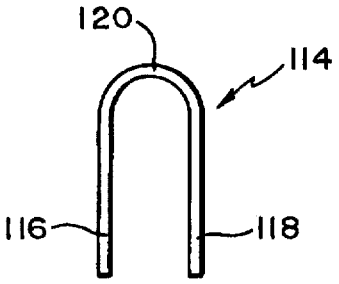
FIG. 13 shows an anchoring member of the present invention.

In order to connect the receiving member to the stove, a plurality of circumferentially spaced anchoring members 114 are welded or otherwise securely attached to the receiving member 110. Each anchoring member of the embodiment illustrated in FIGS. 11 and 12 is provided with a pair of legs. For example, the anchoring member shown in FIG. 13 has generally inverted U-shaped configuration, wherein two spaced apart legs 116 and 118 extend outwardly from a base 120. The legs are spaced apart a distance substantially equal to the average thickness of the gird bar 108. In the case when the safety device is positioned on the cooking range and the base 120 of the anchoring member 114 is spaced above or rests upon the top of the gird bar 108, the legs 116 and 118 are of such vertical length enabling to reach the bottom of recess 104.

FIG. 11 illustrates the safety device 110 with the anchoring member provided for each radial bar of the gird. However, alternate designs are also contemplated. For example, wherein the gird has six radial bars, three anchoring members are sufficient to securely hold the receptacle against movement relative to the gird. In this embodiment the anchoring members should engage alternate ones of the gird bars.

Figure 18:
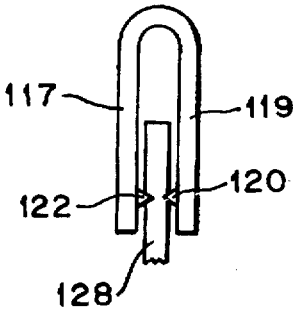
FIG. 18 shows the anchoring member having a detent arrangement.

In the embodiment of FIG. 18, the legs 117 and 119 of the anchoring member are provided with detent portions 120 and 122. While the laterally spaced downwardly projecting legs 117 and 119 straddle the adjacent gird bar 128, the detent portions 120 and 122 engaging corresponding recesses of the gird bars further prevent accidental removal of the safety device from the range. The legs of such anchoring members are spaced apart a distance substantially equal to the average thickness of the gird bar, and are sprung slightly away from each other when the detent portions 120 and 122 engage opposite sides of the gird bar, when the receptacle is being placed thereupon.

Figure 14:
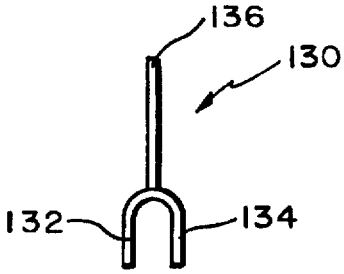
FIG. 14 shows another embodiment of the anchoring member.

FIGS. 14–17 depict alternate embodiments of the anchoring members. For example, FIG. 14 illustrates the anchoring member 130 in which, although the legs 132 and 134 also form an inverted U-shaped element, however, the length of these legs is substantially shorter than the length of the legs 116 and 118 of FIGS. 11, 12, and 13. In the embodiment of FIG. 14, the inverted U-shaped element of the anchoring member is attached to the corresponding receiving member (not shown) by means of an elongated rod 136. The legs 132 and 134 are also spaced apart a distance enabling the legs to straddle and closely receive an adjacent gird bar.

Figure 15:
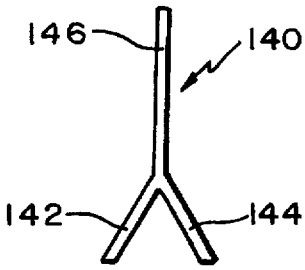
FIG. 15 shows a further embodiment of the anchoring member.
Figure 19:
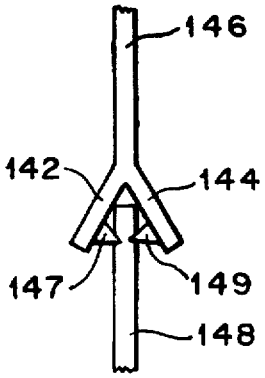
FIG. 19 shows another embodiment of the anchoring member with detent elements.

In FIG. 15 a lower portion 142 of an anchoring member 140 is formed having a inverted Y-shaped configuration with legs 142 and 144 adapted for engagement with corresponding radial bar of the burner gird. The anchoring member of this type is fixedly connected to the receiving member by an elongated rod 146. In the embodiment of FIG. 19, the anchoring member of FIG. 15 also having the inverted Y-shaped configuration is provided with detent portions 147 and 149 engaging opposite sides of the gird bar 148.

Figure 17:
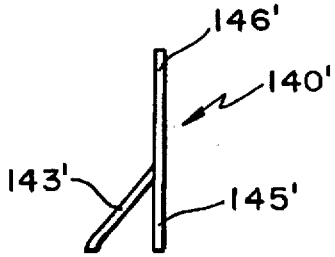
FIG. 17 shows a still further embodiment of the anchoring member.

In FIG. 17 an inverted Y-shaped configuration is anchoring member 140' is formed by an elongated rod 146' connected to the receiving member (not shown), and an auxiliary element 143' positioned at an angle to a lower end thereof 145' forming a fork at that end of the anchoring member. In use, the portions 143' and 145' straddle a corresponding radial bar of the burner gird.

Figure 16:
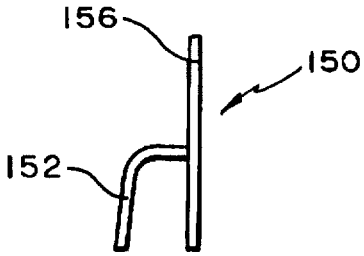
FIG. 16 shows still another embodiment of the anchoring member.

An anchoring member 150 depicted in FIG. 16 comprises an angle shaped member 152 permanently connected to a lower part of an elongated rod 156.

DESCRIPTION OF NEW EMBODIMENT

Figure 20:
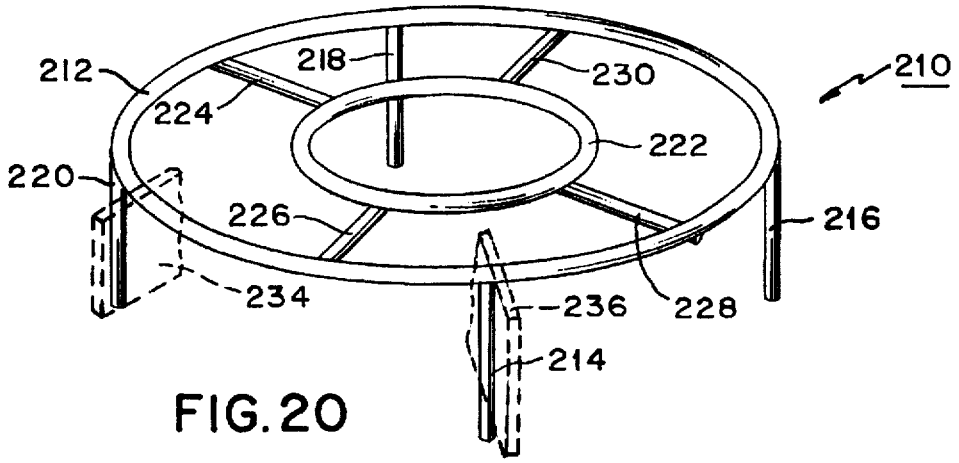
FIG. 20 shows a semi-perspective view of another embodiment of the safety device.

Another embodiment of the safety device 210 is depicted in FIG. 20. A receiving unit of this device consists of an external receiving member 212 and an internal receiving member 222. The external receiving member is concentrically positioned within the receiving member 212. The receiving unit is positioned substantially horizontally and arranged to be spaced above the top portion of the cooking range and burner 105. The internal receiving member 112 is fixedly connected to the external receiving member 212 by a plurality of connecting members 224, 226, 228 and 230. The connecting members are typically welded or by any conventional means permanently attached to the receiving members. The receiving unit is typically provided with four connecting members. However, any suitable number of the connecting members such as 3 or 6, etc. is also contemplated. The main purpose of the connecting members is to insure that the external and internal receiving members are positioned within the same plane and to provide a rigid structure capable of receiving a cooking vessel or utensil and appropriate weight. This is special so in view of the fact that in the safety device 210 outside boundaries of the kitchen utensil could be situated in a space between the external and internal receiving members. In other words, the weight of the kitchen utensil could be imposed on the connecting members 224–230.

In FIG. 20, the safety device 210 is also provided with a plurality of circumferentially spaced anchoring members 214, 216, 218 and 220. Each anchoring member is formed as a rod having one of its ends securely fastened to the external receiving member 212. It should be noted, however, that a modification of the safety device having additional sets of anchoring members permanently connected to the internal receiving member is within the scope of the invention.

It is illustrated in FIG. 20 that two adjacent anchoring members 214 and 220 are situated in such a manner as to be positioned adjacent to or engaging with side surfaces of supporting radial bars or arms 234 and 236 of the supporting gird. It is shown in FIG. 20 that the anchoring members are situated outside a space formed by the adjacent supporting radial bars. 134 and 136. Nevertheless, positioning of the anchoring members, in such a manner that they will be adjacent to the supporting radial bars but positioned within the space formed by these two adjacent bars is within the scope of the invention. Positioning of the anchoring members in the manner discussed hereinabove prevents lateral and/or rotational movement of the safety device and kitchen utensil.

The safety devices 110 and 210 of the present invention are adapted to encircle or closely receive the kitchen utensil. These arrangements are removably mounted on the cooking range to prevent lateral and circumferential displacement but enable movement of the safety device in the vertical direction and replacement. All of the above enables to present invention to provide a simple and inexpensive safety device for a cooking range which effectively prevents lateral and circumferential movement of the cooking vessel and cooking utensil when the base on which the cooking range is installed is moved or displaced by accident.

Figure 21:
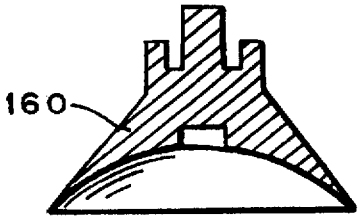
FIG. 21 shows a cross-sectional view of an anchoring suction cup illustrated in FIG. 11.

In order to secure safety of cooking devices further and prevent them from overturning, especially when the stove is installed on a boat, mobile home travel trailer, or the like, legs of the cooking range could be provided with suction cups 160 as is illustrated in FIGS. 11 and 21.

What is claimed is:

1. A safety device for a cooking range having at least one burner grid with supporting radial bars, comprising an open top receiving member for encircling, without any positive locking means, a substantially flat bottom kitchen utensil having no projections extending therefrom other than handle means and/or spout means, and said receiving member having, a plurality of circumferentially spaced anchoring members extending downwardly from said receiving member, each said anchoring member positioned so as to engage said supporting radial bars to prevent lateral and rotational movement of the safety device, and wherein said receiving member comprises two receiving members with an innermost member thereof of a size smaller in diameter than that of the other receiving member.

2. The safety device of claim 1 in which each said anchoring member engages a supporting radial bar through a frictional contact.

3. The safety device of claim 1 in which the receiving members are substantially concentric.

4. A safety device of claim 1, in which used with said cooking range is said kitchen utensil situated within said receiving member.

5. The safety device of claim 1 in which there are two pairs of anchoring members.

6. The safety device of claim 5 in which the two pairs of anchoring members engage two pair of radial support bars.

7. A safety device for a cooking range having at least one burner grid with supporting radial bars comprising an open-top receiving member for encircling without any positive locking means, a substantially flat bottom kitchen utensil having no projections extending therefrom other than handle means and/or spout means, and said receiving member having, a plurality of circumferentially spaced anchoring members extending downwardly from said receiving member, each said anchoring member positioned adjacent to said supporting radial bars to prevent lateral and circumferential movement of said safety device disposed atop said at least one burner grid;

and said receiving member being a plurality of receiving members with an innermost member thereof of a size smaller in diameter than that of an outermost member;

said anchoring members produce a frictional contact with said supporting radial bars.

8. The safety device of claim 7 in which the receiving members are substantially concentric.

9. The combination according to claim 1 in which said receiving members are substantially concentric.

10. In combination, a safety device and a cooking range having at least one burner grid with supporting radial bars, comprising:

an open-top receiving member for encircling, without any positive locking means, a substantially flat bottom kitchen utensil having no projections extending therefrom other than handle means and/or spout means, and said receiving member having, a plurality of circumferentially spaced anchoring members extending downwardly from said receiving member, and engaging said supporting radial bars to prevent lateral and circumferential movement of said safety device; and, said cooking range including means for removably mounting said range to a substrate; said means comprising at least a plurality of suction cups for engaging a substrate supporting said cooking range; and/or tangs removably attached to said substrate.

11. A safety device for a cooking range having at least one burner grid with supporting radial bars, comprising:

a portable stove having a generally rectangular box shaped frame and at least one burner mounted in said box shaped frame;

a substrate having a flat, generally rectangular upper surface portion;

a safety/fastening means operably connected between said stove and said substrate for removably fastening said stove and substrate together and preventing said stove from sliding off of said substrate;

said safety/fastening means being selected from the group consisting of tangs, magnets, suction cups and combinations thereof;

said substrate further including at least one side wall portion extending upwardly from one edge of said surface portion of said substrate; and said safety/fastening means are provided on said at least one side wall portion for removably fastening said stove to said substrate; and wherein said means on said at least one side wall comprises a magnet for holding said stove in place on said substrate.

12. The combination according to claim 11 in which the cooking range includes a plurality of suction cups secured thereto as said safety/fastening means for preventing the movement of said cooking range placed on a substrate.

13. The combination according to claim 11, wherein said safety/fastening means further including a plurality of tangs secured to said cooking range, and apertures in said at least one side wall for engagement with said tangs extending therethrough, and said plurality of tangs each having a cotter pin for precluding accidental removal of said tangs from said apertures.

14. The combination according to claim 11, wherein said safety/fastening means further including a plurality of suction cups secured to said cooking range for preventing movement thereof with respect to the substrate upon which said cooking range is placed.

* * * * *